US007986209B2

(12) United States Patent
Park et al.

(10) Patent No.: US 7,986,209 B2
(45) Date of Patent: Jul. 26, 2011

(54) INDUCTOR USING BULK METALLIC GLASS MATERIAL

(75) Inventors: Chang-min Park, Portland, OR (US); Daewoong Suh, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 851 days.

(21) Appl. No.: 11/943,456

(22) Filed: Nov. 20, 2007

(65) Prior Publication Data

US 2009/0128274 A1 May 21, 2009

(51) Int. Cl.
*H01F 5/00* (2006.01)

(52) U.S. Cl. ..... 336/200

(58) Field of Classification Search ..... 336/65, 336/83, 200, 232–234; 257/531
See application file for complete search history.

(56) References Cited

U.S. PATENT DOCUMENTS

| | | | | |
|---|---|---|---|---|
| 6,943,294 | B2 * | 9/2005 | Kang et al. | 174/541 |
| 7,280,024 | B2 * | 10/2007 | Braunisch | 336/200 |
| 2005/0024908 | A1 * | 2/2005 | Gizara | 363/147 |
| 2008/0150663 | A1 * | 6/2008 | Yeh et al. | 336/83 |

* cited by examiner

*Primary Examiner* — Tuyen Nguyen
(74) *Attorney, Agent, or Firm* — Cool Patent, P.C.; Joseph P. Curtin

(57) ABSTRACT

Inductors using bulk metallic glass (BMG) material and associated methods are generally described. In one example, an apparatus includes an electrically conductive core material, an electrically insulative material coupled with the electrically conductive core material, and a magnetic bulk metallic glass (BMG) material coupled with the electrically insulative material, wherein the electrically conductive core material, the electrically insulative material, and the magnetic BMG material form an inductor.

20 Claims, 4 Drawing Sheets

INDUCTOR USING BULK METALLIC GLASS MATERIAL

BACKGROUND

Generally, discrete inductors may be used to regulate voltage for semiconductor devices.

BRIEF DESCRIPTION OF THE DRAWINGS

Embodiments disclosed herein are illustrated by way of example, and not by way of limitation, in the figures of the accompanying drawings in which like reference numerals refer to similar elements and in which.

Figure 1:
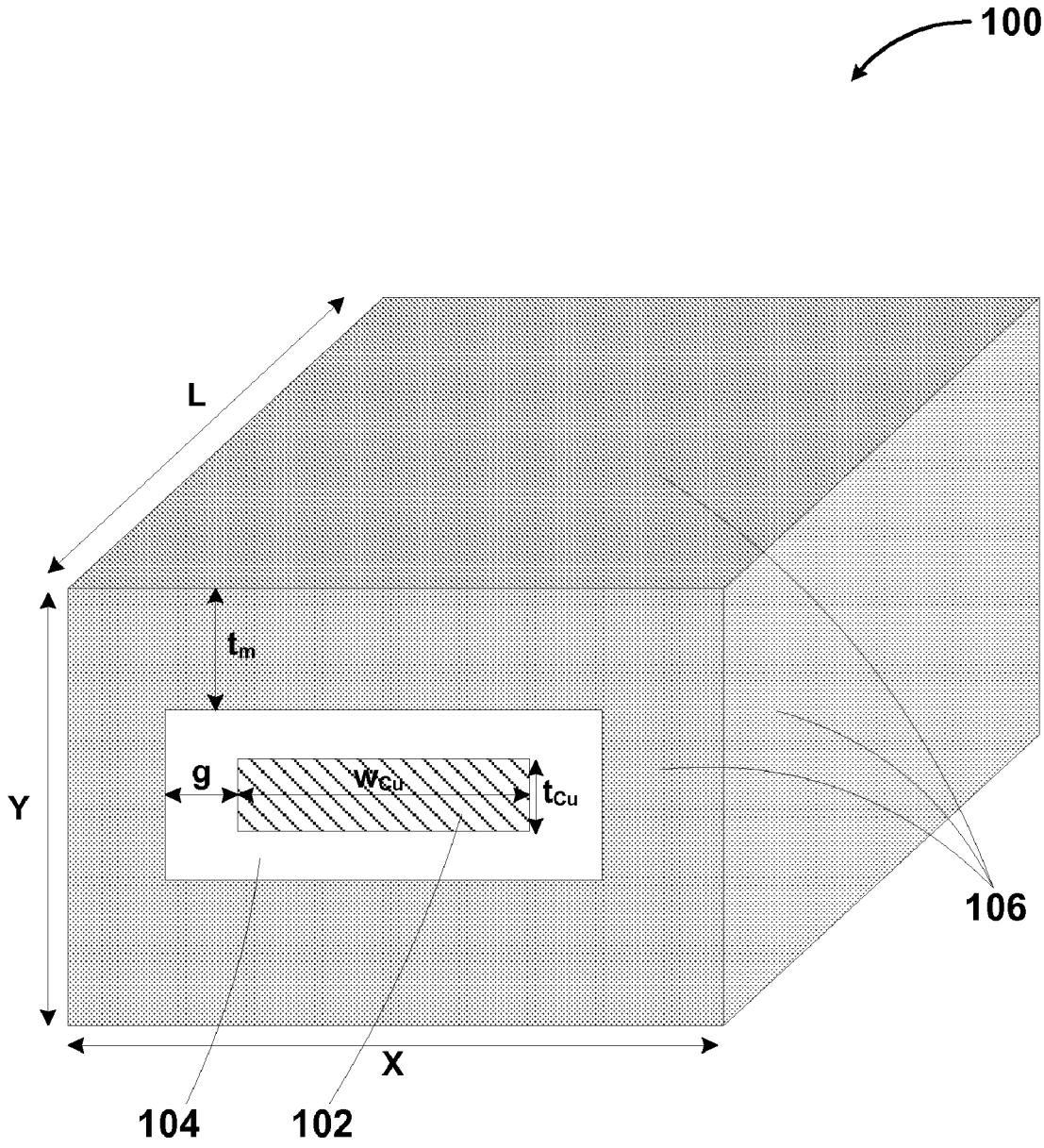
FIG. 1 is a cross-section depiction of an inductor using bulk metallic glass material, according to but one embodiment.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION

Embodiments of an inductor using bulk metallic glass (BMG) material are described herein. In the following description, numerous specific details are set forth to provide a thorough understanding of embodiments disclosed herein. One skilled in the relevant art will recognize, however, that the embodiments disclosed herein can be practiced without one or more of the specific details, or with other methods, components, materials, and so forth. In other instances, well-known structures, materials, or operations are not shown or described in detail to avoid obscuring aspects of the specification.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

FIG. 1 is a cross-section depiction of an inductor using bulk metallic glass material 100, according to but one embodiment. In an embodiment, an inductor 100 includes an electrically conductive core material 102, an electrically insulative material 104, and a magnetic bulk metallic glass (BMG) material 106, each coupled as shown.

Bulk glassy metals or bulk metallic glasses (BMGs) 106 are materials that may exhibit both metallic properties (i.e., electrical, thermal conduction, and high strength/toughness) and polymeric properties (i.e., glass transition, thermoplastic behavior above glass transition temperature, $T_g$). BMG material 106 may exhibit exceptional glass-forming ability and thermal stability similar to polymers. BMG material 106 may be amorphous in the solid state and become viscous liquid above $T_g$. In an embodiment, BMG materials 106 have unique rheological behavior above T, that enables excellent formability and pattern replication ability on the scale of nanometers. In an embodiment, a BMG 106 is amenable to polymer-like processing, such as hot embossing, imprinting, or injection molding. Also, soft ferromagnetic properties of BMG may be superior to conventional soft magnetic materials, such as ferrites. Such magnetic properties of BMG combined with exceptional stability and nanometer scale formability make BMG a suitable material for reducing form factor of inductors in package applications.

In an embodiment, an apparatus 100 includes an electrically conductive core material 102, an electrically insulative material 104 coupled with the electrically conductive core material 102, and a magnetic bulk metallic glass (BMG) material 106 coupled with the electrically insulative material 104, wherein the electrically conductive core material 102, the electrically insulative material 104, and the magnetic BMG material 106 form an inductor 100. In an embodiment, the core material 102 is disposed within the insulative material 104 and the core material 102 and insulative material 104 are disposed within the BMG material 106, as depicted.

In an embodiment, an inductor 100 may be a discrete inductor suitable for use as a voltage regulator in high-frequency applications that require high-current capabilities. In an embodiment, high-frequency applications include frequencies between about 1 MHz and 500 MHz. In another embodiment, high-frequency applications include frequencies up to at least about 500 MHz. High-current applications may include current up to at least about 0.5 A.

In an embodiment, the magnetic BMG material 106 includes saturation magnetization ($I_s$) between about 0.1 to 2 Tesla (T), coercivity ($H_c$) between about 0.01 to 500 Amps/meter (A/m), relative effective permeability ($\mu_e$) at 1 kHz between about 50 to 30,000, relative effective permeability ($\mu_e$) at 1 MHz between about 50 to 10,000, saturation magnetostriction ($\lambda_s$) between about $+/-30\times10^{-6}$, or curry temperature ($T_c$) between about 200° C. and 500° C., or combinations thereof. Relative effective permeability ($\mu_e$) may be relative to the permeability in a vacuum ($\mu_o$), where $\mu_o$ is $4\pi\times10^{-7}$ Henry/meter (H/m). In an embodiment, an inductor 100 includes a magnetic BMG material 106 having properties as described above. In an embodiment, BMG material 106 includes ferromagnetic properties. In another embodiment, magnetic BMG 106 replaces ferrite materials in an inductor.

Table I below includes example BMG 106 magnetic materials and properties, according to but one embodiment.

TABLE I

Soft Magnetic Properties for Example BMG Materials

| Alloy | Soft magnetic properties | | | | | |
|---|---|---|---|---|---|---|
| | $I_s$(T) | $H_c$(A/m) | $\mu_e$(1 kHz) | $\mu_e$(1 MHz) | $\lambda_s(10^{-6})$ | $T_c$(K) |
| $Fe_{56}Co_7Ni_7Zr_{10}B_{20}$ | 0.96 | 2.0 | 19 100 | — | 10 | 594 |
| $Fe_{56}Co_7Ni_7Zr_8Nb_2B_{20}$ | 0.75 | 1.1 | 25 100 | — | 13 | 531 |
| $Co_{56}Fe_{16}Zr_8B_{20}$ | 0.77 | 8.3 | 17 100 | 5500 | 14 | — |

In an embodiment, a BMG material 106 includes $Fe_{56}Co_7Ni_7Zr_{10}B_{20}$, $Fe_{56}Co_7Ni_7Zr_8Nb_2B_{20}$, or $Co_{56}Fe_{16}Zr_8B_{20}$, or suitable combinations thereof, wherein the numbers represent atomic ratios within about +/−1%.

In an embodiment, an inductor 100 includes a small form factor in which the thickness, Y, of the inductor is less than 1 mm, for example. In other embodiments, an inductor 100 includes an inductor length, L, of about 300 μm, a conductive core 102 thickness, $t_{Cu}$, of about 100 μm, a conductive core 102 width, $w_{Cu}$, of about 200 μm, a BMG 106 thickness, $t_m$, of about 250 μm, and a gap distance or insulative material width, g, of about 0.1 μm to 100 μm. In another embodiment, an inductor 100 length, L, is between about 100 μm to about 2 mm. Other dimensions may be similarly scaled in other embodiments. An inductor 100 may have a width, X, of about 500 μm to 1 mm and a thickness, Y, of about 500 μm to 1 mm, in one embodiment.

In an embodiment, an inductor 100 has an inductance of about 50 nH at 5 MHz. In another embodiment, an inductor 100 has an inductance of about 25 nH at 10 MHz. In an embodiment in which a current of about 25 A is used, winding loss may be about 0.4 W and hysteresis loss may be less than about 10 mW, in which the conductive core 102 includes Cu wire having a length of about 500 μm to include contributions from interconnect to bump. In an embodiment, the electrically conductive material 102 includes Cu and the electrically insulative material 104 includes wax. In other embodiments, any suitable electrically conductive material 102 and any suitable electrically insulative material 104 are used.

Figure 2:
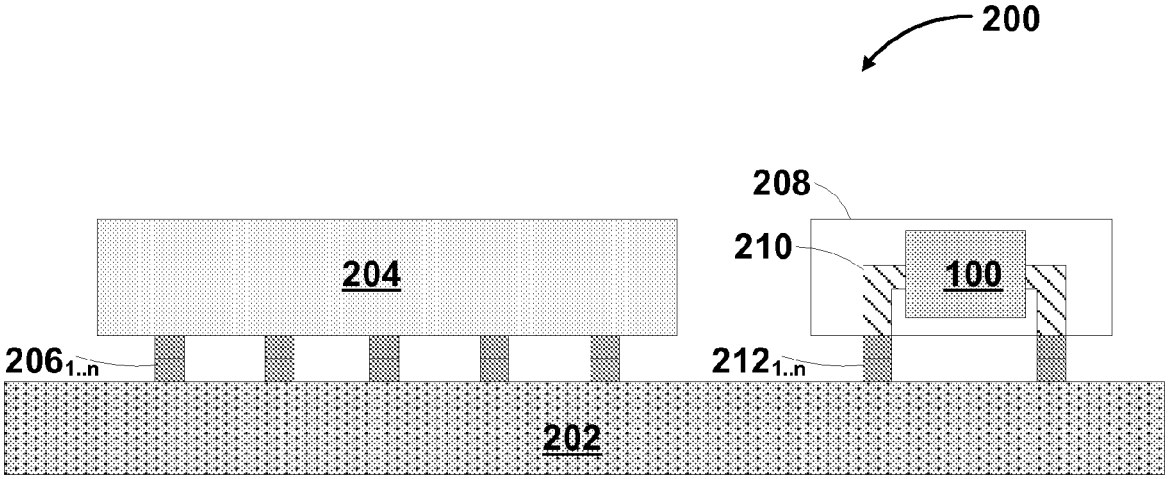
FIG. 2 is a schematic of an electronic assembly including an inductor using bulk metallic glass material, according to but one embodiment.

FIG. 2 is a schematic of an electronic assembly including an inductor using bulk metallic glass material, according to but one embodiment. In an embodiment, an assembly 200 includes a package substrate 202, one or more semiconductor dies 204, one or more bumps $\mathbf{206}_{1 \ldots n}$, inductor 100, inductor housing 208, electrically conductive material 210, and one or more bumps $\mathbf{212}_{1 \ldots n}$, in which n is a positive integer representing a number of repeating structures, each coupled as shown. Housing 208 may be partially transparent in FIG. 2 for illustrative purposes. In an embodiment, electrically conductive material 210 corresponds with electrically conductive material 102 of FIG. 1.

In an embodiment, an assembly 200 includes a package substrate 202 for semiconductor assembly, coupled with an inductor 100 and one or more semiconductor dies 204 coupled with the package substrate 202 wherein the small form factor of the inductor 100 allows for placement of the inductor near the one or more semiconductor dies 204. An inductor 100 may be coupled with the package substrate via one or more electrically conductive bumps $\mathbf{212}_{1 \ldots n}$. In an embodiment, the bumps $\mathbf{212}_{1 \ldots n}$, are electrically coupled with the electrically conductive core material 210 of the inductor 100. The one or more bumps $\mathbf{212}_{1 \ldots n}$, may include C4 bumps, solder bumps, and/or any other electrically conductive material to join an inductor with a package substrate.

Figure 3:
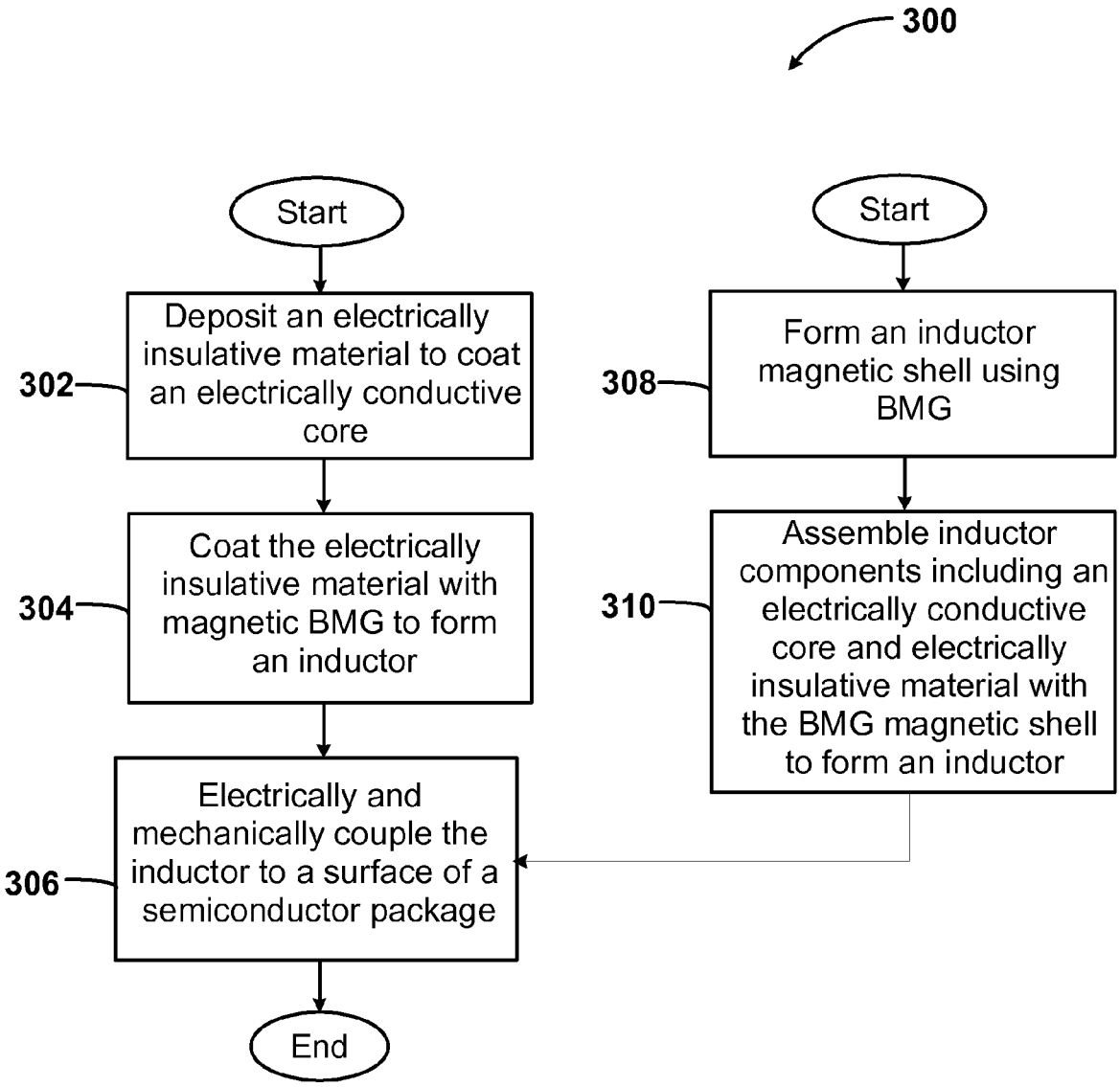
FIG. 3 is a flow diagram of a method for fabricating an inductor using bulk metallic glass material, according to but one embodiment.

FIG. 3 is a flow diagram of a method for fabricating an inductor using bulk metallic glass material, according to but one embodiment. In an embodiment, a method 300 includes depositing an electrically insulative material to coat an electrically conductive core at block 302, substantially coating the electrically insulative material with magnetic BMG to form an inductor at block 304, and electrically and mechanically coupling the inductor to a surface of a semiconductor package at block 306. In another embodiment, a method 300 includes forming an inductor magnetic shell using BMG at block 308, assembling inductor components including an electrically conductive core and electrically insulative material with the BMG magnetic shell to form an inductor at block 310, and electrically and mechanically coupling the inductor to a surface of a semiconductor package at block 306.

In an embodiment, a method 300 includes depositing an electrically insulative material to substantially coat an electrically conductive core 302, and depositing a magnetic bulk metallic glass (BMG) material to substantially coat the electrically insulative material, forming an inductor 304. In an embodiment, depositing a magnetic BMG material 304 includes using polymer-like processing, such as injection molding, for example, to form a magnetic BMG component of an inductor. Forming an inductor magnetic shell using BMG 308 may also be accomplished using polymer-like processing such as injection molding, for example.

A method 300 may include coupling the inductor formed in 304 to a surface of a semiconductor package 306 wherein the inductor is a discrete inductor for use as a voltage regulator in high-frequency applications up to at least about 500 MHz, or high-current applications up to at least about 100 A, or combinations thereof. A method 300 may further include coupling one or more semiconductor dies to a surface of the semiconductor package wherein the size of the inductor allows for placement of the inductor near the one or more semiconductor dies.

In an embodiment, depositing a magnetic BMG material 304 includes depositing $Fe_{56}Co_7Ni_7Zr_{10}B_{20}$, $Fe_{56}Co_7Ni_7Zr_8Nb_2B_{20}$, or $Co_{56}Fe_{16}Zr_8B_{20}$, or suitable combinations thereof, wherein the numbers represent atomic ratios within about +/−1%. In another embodiment, depositing a magnetic BMG material 304 includes depositing magnetic BMG material having saturation magnetization ($I_s$) between about 0.1 to 2 Tesla (T), coercivity ($H_c$) between about 0.01 to 500 Amps/meter (A/m), relative effective permeability ($\mu_e$) at 1 kHz between about 50 to 30,000, relative effective permeability ($\mu_e$) at 1 MHz between about 50 to 10,000, saturation magnetostriction ($\lambda_s$) between about $+/-30\times10^{-6}$, or curry temperature ($T_c$) between about 200° C. and 500° C., or combinations thereof. In yet another embodiment, depositing a magnetic bulk metallic glass (BMG) material 304 to substantially coat the electrically insulative material, forms an inductor comprising a thickness, Y, that is less than about 1 mm, wherein the inductor provides an inductance that is about 50 nH at 5 MHz.

Various operations may be described as multiple discrete operations in turn, in a manner that is most helpful in understanding the invention. The order of description should not however, be construed as to imply that these operations are necessarily order dependent. In particular, these operations need not be performed in the order of presentation. Operations described may be performed in a different order than the described embodiment. Various additional operations may be performed and/or described operations may be omitted in additional embodiments.

Figure 4:
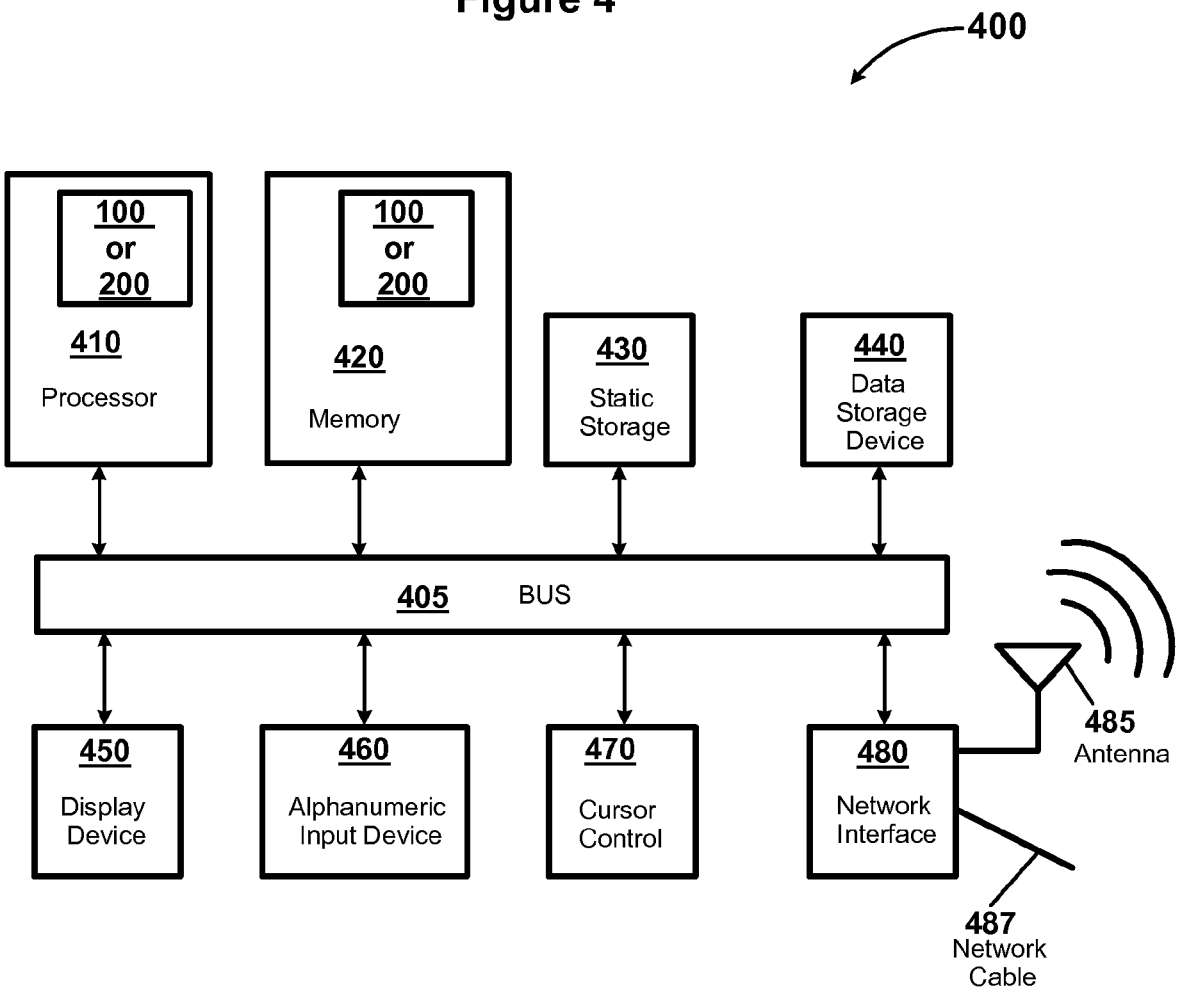
FIG. 4 is a diagram of an example system in which embodiments of the present invention may be used, according to but one embodiment.

FIG. 4 is a diagram of an example system in which embodiments of the present invention may be used, according to but one embodiment. System 400 is intended to represent a range of electronic systems (either wired or wireless) including, for example, desktop computer systems, laptop computer systems, personal computers (PC), wireless telephones, personal digital assistants (PDA) including cellular-enabled PDAs, set top boxes, pocket PCs, tablet PCs, DVD players, or servers, but is not limited to these examples and may include other electronic systems. Alternative electronic systems may include more, fewer and/or different components.

In one embodiment, electronic system 400 includes an inductor using BMG material 100 or an assembly including an inductor using BMG material 200, in accordance with embodiments described with respect to FIGS. 1-3. In an embodiment, an inductor using BMG material 100 or an assembly including an inductor using BMG material 200, as described herein, is part of an electronic system's processor 410 or memory 420.

Electronic system 400 may include bus 405 or other communication device to communicate information, and processor 410 coupled to bus 405 that may process information. While electronic system 400 may be illustrated with a single processor, system 400 may include multiple processors and/or co-processors. In an embodiment, processor 410 includes an inductor using BMG material 100 or an assembly including an inductor using BMG material 200, in accordance with embodiments described herein. System 400 may also include random access memory (RAM) or other storage device 420 (may be referred to as memory), coupled to bus 405 and may store information and instructions that may be executed by processor 410.

Memory 420 may also be used to store temporary variables or other intermediate information during execution of instructions by processor 410. Memory 420 is a flash memory device in one embodiment. In another embodiment, memory 420 includes an inductor using BMG material 100 or an assembly including an inductor using BMG material 200 as described herein.

System 400 may also include read only memory (ROM) and/or other static storage device 430 coupled to bus 405 that may store static information and instructions for processor 410. Data storage device 440 may be coupled to bus 405 to store information and instructions. Data storage device 440 such as a magnetic disk or optical disc and corresponding drive may be coupled with electronic system 400.

Electronic system 400 may also be coupled via bus 405 to display device 450, such as a cathode ray tube (CRT) or liquid crystal display (LCD), to display information to a user. Alphanumeric input device 460, including alphanumeric and other keys, may be coupled to bus 405 to communicate information and command selections to processor 410. Another type of user input device is cursor control 470, such as a mouse, a trackball, or cursor direction keys to communicate information and command selections to processor 410 and to control cursor movement on display 450.

Electronic system 400 further may include one or more network interfaces 480 to provide access to network, such as a local area network. Network interface 480 may include, for example, a wireless network interface having antenna 485, which may represent one or more antennae. Network interface 480 may also include, for example, a wired network interface to communicate with remote devices via network cable 487, which may be, for example, an Ethernet cable, a coaxial cable, a fiber optic cable, a serial cable, or a parallel cable.

In one embodiment, network interface 480 may provide access to a local area network, for example, by conforming to an Institute of Electrical and Electronics Engineers (IEEE) standard such as IEEE 802.11b and/or IEEE 802.11g standards, and/or the wireless network interface may provide access to a personal area network, for example, by conforming to Bluetooth standards. Other wireless network interfaces and/or protocols can also be supported.

IEEE 802.11b corresponds to IEEE Std. 802.11b-1999 entitled "Local and Metropolitan Area Networks, Part 11: Wireless LAN Medium Access Control (MAC) and Physical Layer (PHY) Specifications: Higher-Speed Physical Layer Extension in the 2.4 GHz Band," approved Sep. 16, 1999 as well as related documents. IEEE 802.11g corresponds to IEEE Std. 802.11g-2003 entitled "Local and Metropolitan Area Networks, Part 11: Wireless LAN Medium Access Control (MAC) and Physical Layer (PHY) Specifications, Amendment 4: Further Higher Rate Extension in the 2.4 GHz Band," approved Jun. 27, 2003 as well as related documents. Bluetooth protocols are described in "Specification of the Bluetooth System: Core, Version 1.1," published Feb. 22, 2001 by the Bluetooth Special Interest Group, Inc. Previous or subsequent versions of the Bluetooth standard may also be supported.

In addition to, or instead of, communication via wireless LAN standards, network interface(s) 480 may provide wireless communications using, for example, Time Division, Multiple Access (TDMA) protocols, Global System for Mobile Communications (GSM) protocols, Code Division, Multiple Access (CDMA) protocols, and/or any other type of wireless communications protocol.

In an embodiment, a system 400 includes one or more omnidirectional antennae 485, which may refer to an antenna that is at least partially omnidirectional and/or substantially omnidirectional, and a processor 410 coupled to communicate via the antennae.

The above description of illustrated embodiments, including what is described in the Abstract, is not intended to be exhaustive or to limit to the precise forms disclosed. While specific embodiments and examples are described herein for illustrative purposes, various equivalent modifications are possible within the scope of this description, as those skilled in the relevant art will recognize.

These modifications can be made in light of the above detailed description. The terms used in the following claims should not be construed to limit the scope to the specific embodiments disclosed in the specification and the claims. Rather, the scope of the embodiments disclosed herein is to be determined entirely by the following claims, which are to be construed in accordance with established doctrines of claim interpretation.

What is claimed is:

1. An apparatus, comprising:

an electrically conductive core material, the electrically conductive core material being formed into a single-direction linear shape, the linear shape comprising a length and a width;

an electrically insulative material coupled with the electrically conductive core material; and a magnetic bulk metallic glass (BMG) material coupled with the electrically insulative material, the electrically conductive core material, the electrically insulative material, and the magnetic BMG material forming an inductor, the core material being disposed within the insulative material, and the core material and insulative material being disposed within the BMG material.

2. An apparatus according to claim 1, wherein the inductor comprises a discrete inductor suitable for use as a voltage regulator in high-frequency applications up to at least about 500 MHz, or high-currently applications up to at least about 100 A, or combinations thereof.

3. An apparatus according to claim 1, wherein the magnetic BMG material comprises $Fe_{56}Co_7Ni_7Zr_{10}B_{20}$, $Fe_{56}Co_7Ni_7Zr_8Nb_2B_{20}$, or $Co_{56}Fe_{16}Zr_8B_{20}$, or suitable combinations thereof, and wherein the numbers represent atomic ratios within about +/−1%.

4. An apparatus according to claim 1, wherein the magnetic BMG material comprises saturation magnetization ($I_s$) between about 0.1 to 2 Tesla (T), coercivity ($H_c$) between about 0.01 to 500 Amps/meter (A/m), relative effective permeability ($\mu_e$) at 1 kHz between about 50 to 30,000, relative effective permeability ($\mu_e$) at 1 MHz between about 50 to 10,000, saturation magnetostriction ($\lambda_s$) between about $+/-30\times10^{-6}$, or curry temperature ($T_c$) between about 200° C. and 500° C., or combinations thereof.

5. An apparatus according to claim 1, wherein the electrically conductive material comprises copper, and wherein the electrically insulative material comprises wax.

6. An apparatus according to claim 1, wherein a thickness of the inductor is less than about 1 mm, and wherein an inductance of the inductor comprises about 50 nH at 5 MHz.

7. An apparatus according to claim 1, further comprising:

a package substrate coupled with the inductor; and one or more semiconductor dies coupled with the package substrate, a size of the inductor allowing for placement of the inductor near the one or more semiconductor dies.

8. An apparatus according to claim 6, wherein the inductor is electrically and mechanically coupled to the package substrate via one or more electrically conductive bumps, the bumps being electrically coupled with the electrically conductive core material of the inductor.

9. An apparatus, comprising:

an electrically conductive core material;

an electrically insulative material coupled with the electrically conductive core material; and a magnetic bulk metallic glass (BMG) material coupled with the electrically insulative material, the electrically conductive core material, the electrically insulative material, and the magnetic BMG material forming an inductor, the core material being disposed within the insulative material, the core material and insulative material being disposed within the BMG material, the magnetic BMG material comprising saturation magnetization ($I_s$) between about 0.1 to 2 Tesla (T), coercivity ($H_c$) between about 0.01 to 500 Amps/meter (A/m), relative effective permeability ($\mu_e$) at 1 kHz between about 50 to 30,000, relative effective permeability ($\mu_e$) at 1 MHz between about 50 to 10,000, saturation magnetostriction ($\lambda_s$) between about $+/-30\times10^{-6}$, or curry temperature ($T_c$) between about 200° C. and 500° C., or combinations thereof.

10. An apparatus according to claim 9, wherein the inductor comprises a discrete inductor suitable for use as a voltage regulator in high-frequency applications up to at least about 500 MHz, or high-current applications up to at least about 100 A, or combinations thereof.

11. An apparatus according to claim 9, wherein the magnetic BMG material comprises $Fe_{56}Co_7Ni_7Zr_{10}B_{20}$, $Fe_{56}Co_7Ni_7Zr_8Nb_2B_{20}$, or $Co_{56}Fe_{16}Zr_8B_{20}$, or suitable combinations thereof, and wherein the numbers represent atomic ratios within about +/−1%.

12. An apparatus according to claim 9, wherein the electrically conductive material comprises copper, and wherein the electrically insulative material comprises wax.

13. An apparatus according to claim 9, wherein a thickness of the inductor comprises less than about 1 mm, and wherein an inductance of the inductor is about 50 nH at 5 MHz.

14. An apparatus according to claim 13, wherein the inductor is electrically and mechanically coupled to the package substrate via one or more electrically conductive bumps, the bumps being electrically coupled with the electrically conductive core material of the inductor.

15. An apparatus according to claim 9, further comprising:

a package substrate coupled with the inductor; and one or more semiconductor dies coupled with the package substrate, a size of the inductor allowing for placement of the inductor near the one or more semiconductor dies.

16. An apparatus, comprising:

an electrically conductive core material;

an electrically insulative material coupled with the electrically conductive core material; and a magnetic bulk metallic glass (BMG) material coupled with the electrically insulative material, the electrically conductive core material, the electrically insulative material, and the magnetic BMG material forming an inductor, the core material being disposed within the insulative material, and the core material and insulative material being disposed within the BMG material, the inductor being electrically and mechanically coupled to the package substrate via one or more electrically conductive bumps, the bumps being electrically coupled with the electrically conductive core material of the inductor, a thickness of the inductor being less than about 1 mm, and an inductance of the inductor comprising about 50 nH at 5 MHz.

17. An apparatus according to claim 1, wherein the electrically insulative material comprising a length and a width respectively corresponding to the length and the width of the electrically conductive core material, and wherein the magnetic bulk glass (BMG) material comprises a length and a width respectively corresponding to the length and the width of the electrically conductive core material.

18. An apparatus according to claim 17, wherein the inductor comprises a discrete inductor suitable for use as a voltage regulator in high-frequency applications up to at least about 500 MHz, or high-currently applications up to at least about 100 A, or combinations thereof.

19. An apparatus according to claim 18, wherein the magnetic BMG material comprises $Fe_{56}Co_7Ni_7Zr_{10}B_{20}$, $Fe_{56}Co_7Ni_7Zr_8Nb_2B_{20}$, or $Co_{56}Fe_{16}Zr_8B_{20}$, or suitable combinations thereof, and wherein the numbers represent atomic ratios within about +/−1%.

20. An apparatus according to claim 19, wherein the electrically conductive material comprises copper, and wherein the electrically insulative material comprises wax.

* * * * *